US005885709A

United States Patent [19]

Wick et al.

[11] Patent Number: 5,885,709

[45] **Date of Patent: *Mar. 23, 1999**

[54] CARBODIIMIDE-MODIFIED POLYESTER FIBER AND PREPARATION THEREOF

[75] Inventors: Gottfried Wick; Erhard Krüger, both of Bobingen; Herbert Zeitler, Königsbrunn, all of Germany

[73] Assignee: Hoechst Aktiengesellschaft, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 735,317

[22] Filed: Oct. 25, 1996

Related U.S. Application Data

[63] Continuation of Ser. No. 849,763, Mar. 12, 1992.

[30] Foreign Application Priority Data

Mar. 14, 1991 [DE] Germany ..... 41 08 278.8

[51] Int. Cl.[6] ..... D02G 3/00; C08K 5/29; C08F 20/00

[52] U.S. Cl. ..... 428/364; 525/437; 525/440; 525/452; 525/511; 525/540; 428/364; 524/195

[58] Field of Search ..... 525/437, 440, 525/452, 511, 540; 524/195; 428/364

[56] References Cited

U.S. PATENT DOCUMENTS

| | | | |
|---|---|---|---|
| 3,193,522 | 7/1965 | Neumann et al. | 524/195 |
| 3,193,523 | 7/1965 | Neumann et al. | 560/2 |
| 3,193,524 | 7/1965 | Holtschmidt | 523/508 |
| 3,972,933 | 8/1976 | Lawton | 564/252 |
| 3,975,329 | 8/1976 | Barnewell et al. | 524/437 |
| 4,022,752 | 5/1977 | Horn et al. | 524/98 |
| 4,071,503 | 1/1978 | Thomas et al. | 525/440 |
| 4,772,649 | 9/1988 | Andrews et al. | 524/195 |

FOREIGN PATENT DOCUMENTS

| | | |
|---|---|---|
| A-0417 717 | 3/1991 | European Pat. Off. . |
| A-1 224 635 | 3/1971 | United Kingdom . |
| WO-A-8 301 253 | 4/1983 | WIPO . |

OTHER PUBLICATIONS

English language abstract of CH–A–621 135 (Inventa AG ); 15, Jan. 1981.

*Primary Examiner*—Samuel A. Acquah
*Attorney, Agent, or Firm*—Connolly & Hutz

[57] ABSTRACT

There are described polyester fibers and filaments which, following reaction with carbodiimides, have capped carboxyl end groups, the carboxyl end groups being predominantly capped by reaction with mono- and/or biscarbodiimides which are present in the fibers and filaments in an amount of from 30 to 200 ppm, based on the weight of the polyester, the free carboxyl end group content being less than 3 meq/kg of polyester, and the fibers and filaments additionally containing at least 0.02 percent by weight of at least one free polycarbodiimide or of a reaction product containing still reactive carbodiimide groups, and also a process for the preparation thereof.

The filaments described are suitable in particular for producing papermaker's machine wire-cloths.

20 Claims, No Drawings

CARBODIIMIDE-MODIFIED POLYESTER FIBER AND PREPARATION THEREOF

This application is a continuation of application Ser. No. 07/849,763 filed Mar. 12, 1992.

The present invention relates to polyester fibers, preferably polyester monofilaments, which have been stabilized against thermal and in particular hydrolytic degradation by the addition of a combination of mono- and polycarbodiimides, and to suitable processes for preparing them.

It is known that polyester molecules are thermolyzed in such a way that, for example in the case of polyethylene terephthalate, the ester bond is cleaved to form a carboxyl end group and a vinyl ester, which vinyl ester then reacts further by eliminating acetaldehyde. Such a thermal decomposition is influenced in particular by the reaction temperature, the residence time and possibly the nature of the polycondensation catalyst.

In contradistinction thereto, the hydrolysis resistance of a polyester is strongly dependent on the number of carboxyl end groups per unit weight. It is known to achieve an improvement in hydrolysis resistance by capping these carboxyl end groups in chemical reactions. Reactions which have been repeatedly described as suitable for capping carboxyl end groups are those with aliphatic, aromatic but also cycloaliphatic mono-, bis- or polycarbodiimides.

For instance, DE Offenlegungsschrift 1,770,495 describes stabilized polyethylene glycol terephthalates obtained by addition of polycarbodiimides. Because, in general, polycarbodiimides give a lower reaction rate, it is necessary to ensure a longer residence time of the polycarbodiimide in the polyester melt. For this reason, polycarbodiimides have been added even in the course of the polycondensation reaction of the polyester, i.e. in the formation phase thereof. However, this is associated with a number of disadvantages. For example, the long residence time gives rise to a multiplicity of by-products and in some instances even the actual polycondensation reaction leading to the polyester is interfered with.

In contradistinction thereto, it is known that monocarbodiimides and biscarbodiimides react significantly faster with polyester melts. For this reason it is possible to shorten the time for mixing and reacting to such an extent that these materials can be added to the polyester granules directly upstream of the spinning extruder before the granules are melted. References for the use of biscarbodiimides for this purpose are D. E. Offenlegungsschrift 2,020,330 and for the use of monocarbodiimides DE Auslegeschrift 2,458,701 and JA Auslegeschrift 1-15604/89.

The last two Auslegeschriften mentioned are specifically directed to the preparation of stabilized polyester filaments, and in both cases a small excess of carbodiimide in the ready-prepared filament is recommended. According to the examples given in DE Auslegeschrift 2,458,701, the excess over the stoichiometrically required amount should be up to 7.5 meq/kg of polyester, while JA Auslegeschrift 1-15604/89 requires an excess of from 0.005 to 1.5% by weight of the monocarbodiimide which is specifically recommended therein. In both cases the calculation of the stoichiometrically necessary amount takes into account the fact that melting the polymer to make it spinnable will produce some additional carboxyl groups through thermal degradation, and these carboxyl groups also need capping. As seen in particular in JP Auslegeschrift 1-15604/89, it is of particular importance for the desired thermal and hydrolytic stability of the filaments produced therefrom that the ready-produced filaments, specifically monofilaments, still contain free carbodiimide, since otherwise, for example under the very aggressive conditions in a papermaker's machine, such materials would quickly become unusable. Said JP Auslegeschrift further reveals that the use of polycarbodiimides does not correspond to the previously attained state of the art.

The disadvantage of all prior art processes which use an excess of mono- or biscarbodiimides is that, owing to the not inconsiderable volatility of these products, in particular of the thermally and hydrolytically produced lysis products, for example the corresponding isocyanates and aromatic amines, noticeable exposure levels are a burden for the operating personnel and the environment. Owing to their particular properties, stabilized polyester filaments are customarily used at elevated temperatures and usually in the presence of steam. Under these conditions, such exposure due to excess carbodiimide and secondary products thereof must be expected. Because of their volatility it is likely that these compounds will diffuse out of the polyester or else for example may be extractable therefrom by solvents or mineral oils. Thus, in the long run, an adequate depot effect is not ensured.

Given this state of the art it is still a desirable object to devise a way of stabilizing polyester filaments whereby on the one hand ideally all carboxyl end groups are capped within short residence times while on the other the nuisance due to volatile mono- or biscarbodiimides and secondary products thereof and its attendant disadvantages is at least reduced to a minimum.

It has been found, surprisingly, that this object can be achieved by using mixtures of certain carbodiimides. The present invention accordingly provides polyester fibers and filaments where the capping of the carboxyl end groups is predominantly effected by reaction with mono- and/or biscarbodiimides but the fibers and filaments according to the present invention contain only from 30 to 200 ppm of these carbodiimides in free form.

Although the free mono- and/or biscarbodiimide content of polyesters should ideally be nil, it has now been found that fibers and filaments which contain not more than 200 ppm of these substances in free form are very highly suitable for applications in apparatus which is completely sealed or equipped with waste air and water treatment facilities.

An example of such an application of the fibers and filaments according to the present invention is their use for the manufacture of papermaker's machine wire-cloths.

However, in order to have the necessary stability, for example against hydrolysis, despite the relatively low level of free mono- and/or biscarbodiimides, it is necessary for the polyester fibers and filaments to contain in addition at least 0.02% of at least one polycarbodiimide, which polycarbodiimide should be present in free form or with at least some reactive carbodiimide groups left over. The desired polyester fibers and filaments possessing appreciably improved stabilities to thermal and/or hydrolytic attack should contain less than 3 meq/kg of carboxyl end groups in the polyester. Preference is given to fibers and filaments where the number of carboxyl end groups have been reduced to less than 2, preferably even less than 1.5, meq/kg of polyester. The level of free mono- and/or biscarbodiimides should preferably from 30 to 150 ppm, in particular from 30 to 100 ppm, based on the weight of polyester.

Care must be taken to ensure that the fibers and filaments additionally contain polycarbodiimides or reaction products thereof containing still reactive groups. Preference is given to concentrations of from 0.05 to 0.6, in particular from 0.1 to 0.5, % by weight of polycarbodiimide in the polyester fibers and filaments. The molecular weight of suitable carbodiimides is between 2000 and 15,000, preferably between 5000 and about 10,000.

To produce high performance fibers it is necessary to use polyesters which have a high average molecular weight corresponding to an intrinsic viscosity (limiting viscosity) of at least 0.64 [dl/g]. The measurements were carried out in dichloroacetic acid at 25° C.

The novel process for preparing the claimed stabilized polyester fibers and filaments consists in the addition of mono- and/or biscarbodiimide in an amount of 0.5% by weight or less, based on polyester, and additionally an amount of at least 0.05% by weight of a polycarbodiimide. Within these ranges and while taking account of the number of carboxyl end groups present in the starter polyester, the amounts of mono- and/or biscarbodiimides and of polycarbodiimides are chosen in such a way that the resulting polyester contains from 30 to 200 ppm, preferably from 30 to 150 ppm, in particular from 30 to 100 ppm, of mono- and/or biscarbodiimides and at least 0.02% by weight of polycarbodiimides.

This mixture of polyester and carbodiimides can be conventionally spun into filaments, specifically monofilaments, or staple fibers and further processed.

According to the present invention it is advantageous if the polyesters which are spun already contain a low level of carboxyl end groups from their manner of preparation. This can be achieved for example by using the solid state condensation process. It has been found that starting polyesters should contain less than 20, preferably even less than 10, meq of carboxyl end groups per kg. These values already take into account the increase in the number of carboxyl end groups due to the melting process.

Polyesters and carbodiimides should not be stored infinitely long at high temperatures. As pointed out earlier, additional carboxyl end groups are formed in the course of the melting of polyesters. Similarly, the carbodiimides used can decompose at the high temperatures of polyester melts. It is therefore desirable to limit as far as possible the contact or reaction time between the carbodiimide additions and the molten polyesters. If melt extruders are used, it is possible to cut this residence time in the molten state to less than 5, preferably less than 3, minutes. The melting time in the extruder is limited only by the requirement that satisfactory reaction between carbodiimide and polyester carboxyl end groups requires adequate mixing of the reactants. This can be achieved through appropriate extruder design or for example through using static mixers.

In principle, the present invention can be carried out with any filament-forming polyester, i.e. aliphatic/aromatic polyesters such as polyethylene terephthalates or polybutylene terephthalates, but it is also possible in the same way to use wholly aromatic and for example halogenated polyesters. Units making up filament-forming polyesters are preferably diols and dicarboxylic acids or appropriate hydroxycarboxylic acids. The main constituent of polyester is terephthalic acid, but it is of course also possible to use other preferably para- or transdisposed compounds such as 2,6-naphthalenedicarboxylic acid as well as p-hydroxybenzoic acid. Typical suitable dihydric alcohols would be for example ethylene glycol, propanediol, 1,4-butanediol but also hydroquinone etc. Preferred aliphatic diols have from two to four carbon atoms. Particular preference is given to ethylene glycol. However, longer-chain diols can be used in proportions of up to about 20 mol %, preferably less than 10 mol %, for modifying the properties.

However, for particular technical duties it has proved advisable to use in particular high molecular weight polymers of pure polyethylene terephthalate and the copolymers thereof with small amounts of comonomers, provided the heat stress is in fact in line with the properties of polyethylene terephthalate. Otherwise it is necessary to resort to suitable known wholly aromatic polyesters.

Particular preference is accordingly given to polyester fibers and filaments according to the present invention which consist predominantly or wholly of polyethylene terephthalate, in particular those which have a molecular weight corresponding to an intrinsic viscosity (limiting viscosity) of at least 0.64, preferably at least 0.70, [dl/g]. The intrinsic viscosities are measured in dichloroacetic acid at 25° C. The stabilization of the filaments and fibers according to the present invention is achieved by adding a combination of a mono- and/or biscarbodiimide on the one hand and a polymeric carbodiimide on the other. Preference is given to the use of monocarbodiimides, since they are notable in particular for a high rate of reaction with the carboxyl end groups of the polyester. However, if desired, they can be replaced in part or as a whole with corresponding amounts of biscarbodiimides in order to utilize the clearly lower volatility of these compounds. However, in this case it is necessary to ensure that the contact time is sufficiently long to ensure adequate reaction in the course of mixing and melting in the melt extruder even with biscarbodiimides.

The carboxyl groups still left over in the polyesters after the polycondensation should be predominantly capped according to the process of the present invention by reaction with a mono- or biscarbodiimide. A relatively small proportion of the carboxyl end groups will also react under these conditions according to the present invention with carbodiimide groups on the polycarbodiimide additionally used.

The polyester fibers and filaments according to the present invention therefore, instead of carboxyl end groups, essentially contain reaction products thereof with the carbodiimides used. Mono- and biscarbodiimides which, if at all, are present in the fibers and filaments in very small amounts are the known aryl-, alkyl- and cycloalkylcarbodiimides. In the case of the diarylcarbodiimides, which are preferred, the aryl nuclei can be unsubstituted. Preferably, however, the aromatic carbodiimides used are substituted and hence sterically hindered in the 2- or 2,6-position. DE Auslegeschrift 1,494,009 already mentions a multiplicity of monocarbodiimides with steric hinderance of the carbodiimide group. Particularly suitable monocarbodiimides are for example N,N'-(di-o-tolyl)carbodiimide and N,N'-(2,6,2',6'-tetraisopropyl)diphenylcarbodiimide. Biscarbodiimides which are suitable for the purposes of the present invention are described for example in DE Offenlegungsschrift 2,020,330.

As polycarbodiimides suitable for the purposes of the present invention it is possible to use compounds where the carbodiimide units are linked via mono- or disubstituted aryl nuclei, possible aryl nuclei being phenylene, naphthylene, biphenylene and the divalent radical derived from diphenylmethane and the substituents corresponding by type and location to the substituents of the monodiarylcarbodiimides which are substituted in the aryl nucleus.

A particularly preferred polycarbodiimide is the commercially available aromatic polycarbodiimide which is substituted on the benzene ring by isopropyl in the o-position relative to the carbodiimide groups, i.e. in the 2,6- or 2,4,6-position.

The polycarbodiimides which are present in the free or bound form in the polyester filaments according to the present invention preferably have an average molecular weight of from 2000 to 15,000, but in particular from 5000 to 10,000. As mentioned earlier, these polycarbodiimides react with the carboxyl end groups at a distinctly lower rate. If such a reaction does occur, preferably at first only one group of the carbodiimide will react. However, the other groups present in the polymer carbodiimide will give to the desired depot effect and are responsible for the significantly improved stability of the resulting fibers and filaments. For the extruded polyester compositions to have this desired thermal and in particular hydrolytic stability it is therefore crucial that the polymeric carbodiimides present therein are not fully converted but still contain free carbodiimide groups for capping further carboxyl end groups.

The produced polyester fibers and filaments according to the present invention may contain customary additives, for example titanium dioxide as delusterant and additives for example for improving the dyeability or for reducing electrostatic charge buildup. Similarly, it is of course also possible to use additions or comonomers to produce the flammability of the produced fibers and filaments in a conventional manner.

It is also possible for example for color pigments, carbon black or soluble dyes to be incorporated into the polyester melt or be already present therein. By mixing in other polymers, for example polyolefins, polyesters, polyamides or polytetrafluoroethylenes it is possible, in certain circumstances, to achieve completely new textile-technological effects. Similarly, the addition of crosslinking substances and similar additives may be beneficial for selected fields of use.

As mentioned earlier, the preparation of the polyester fibers and filaments according to the present invention requires mixing and melting. Preferably, this melting can be carried out in a melt extruder directly prior to the actual spinning process. The addition of carbodiimides can be effected by mixing into the polyester chips, impregnating the polyester material with suitable solutions of the carbodiimides upstream of the extruder, or else by sprinkling or the like. A further manner of addition is, in particular for the addition of the polymeric carbodiimides, the preparation of masterbatches in polyesters. These concentrates can be mixed into the polyester material to be treated at a point directly upstream of the extruder or else, if for example a twin-screw extruder is used, in the extruder itself. If the polyester material to be spun is not present in chips form but instead for example is being continuously supplied in melt form, it is necessary to provide appropriate metering devices for the carbodiimide, optionally in molten form.

As mentioned earlier, the amount of mono- and/or biscarbodiimide to be added in a particular case depends on the carboxyl end group content of the starting polyester taking into account the additional carboxyl end groups which are likely to form in the course of the melting process. It is necessary to take care here to avoid losses due to premature evaporation of the mono- or biscarbodiimides used. A preferred form of adding the polycarbodiimide is the addition of masterbatches which contain a higher percentage, for example 15%, of polycarbodiimide in a customary granular polymeric polyester.

Particular attention should be drawn once more to the danger of secondary reactions, which exists due to the thermal stress of the conjoint melting process not only for the polyester but also for the carbodiimides used. For this reason the residence time of the carbodiimides in the melt should preferably be less than 5 min, in particular less than 3 min. Under these conditions, and given thorough mixing, the amounts of mono- or biscarbodiimide used react substantially quantitatively; that is, they are subsequently no longer detectable in free form in the extruded filaments. Another reaction takes place as well, albeit to a significantly smaller extent, involving some of the carbodiimide groups of the polycarbodiimides used, which, however, perform primarily the depot function. This measure has made it possible for the first time to produce polyester fibers and filaments which enjoy effective and prolonged protection against thermal and especially hydrolytic degradation, although they contain smaller amounts of free mono- and/or biscarbodiimides and lysis and secondary products thereof than similar known products, which small amounts of these substances are removable by waste air and water treatment measures to such an extent that they cause no nuisance or harm to the environment. The presence of polymeric carbodiimides ensures the desired long-term stabilization of the polyester materials thus treated. It is surprising that this function is reliably achieved by the polycarbodiimides, given that stabilization trials using these compounds alone did not lead to the required stabilization.

The use of polymeric carbodiimides for long-term stabilization results not only in a lower thermal decomposability and lower volatility of these compounds but also in significantly greater safety from a toxicological viewpoint. This applies in particular to all the polymer molecules of polycarbodiimides which have already been chemically bound to the polyester material with at least one carbodiimide group via a carboxyl end group of the polyester.

EXAMPLES

The examples which follow serve to illustrate the invention. In all the examples, a dried, solid state condensed polyester granular product having an average carboxyl end group content of 5 meq/kg of polymer was used. The monomeric carbodiimide used was N,N'-2,2',6,6'-tetraisopropyldiphenylcarbodiimide. The polymeric carbodiimide used in the experiments described hereinafter was an aromatic polycarbodiimide which possessed benzene nuclei which were each substituted by isopropyl in the opposition, i.e. in the 2,6- or 2,4,6-position. It was used not in the pure state but as a masterbatch (15% of polycarbodiimide in polyethylene terephthalate-commercial product ®Stabaxol KE 7646 from Rhein-Chemie, Rheinhausen, Germany).

The carbodiimide was mixed with the masterbatch and the polymer material in vessels by mechanical shaking and stirring. This mixture was then fed into a single-screw extruder from Reifenhäuser, Germany, model S 45 A. The individual extruder zones had temperatures of from 282° to 293° C. and the extruder was run with an output of 500 g of melt/min using customary spinning dies for monofilaments. The residence time of the mixtures in the molten state was 2.5 min. The freshly spun monofilaments, having travelled through a short air passage, were quenched in a water bath and then continuously drawn in two stages. The draw ratio was 4.3:1 in all experiments. The temperature at the first drawing stage was 80° C. and at the second drawing stage 90° C., while the transport speed of the filaments on leaving the quench bath was 32 m/min. Thereafter the filaments were heat set in a setting duct at a temperature of 275° C. All the spun monofilaments had a final diameter of 0.4 mm. To test their stability, the monofilaments obtained were tensile tested once immediately following production and the second time following 80 hours' storage at 135° C. in a water vapor atmosphere. Thereafter the tensile strength was determined again and the ratio was calculated between the residual tensile strength and the original tensile strength. The ratio is a measure of the stabilization achieved with the additives.

Example 1

In this example, monofilaments were spun without any addition whatsoever. The samples obtained were of course free of monocarbodiimide and the carboxyl end group content was 6.4 meq/kg of polymer. The Table below summarizes the experimental conditions and the results obtained.

Example 2

This example is likewise carried out for comparison. Again a monofilament was prepared under the conditions of Example 1, except that 0.6% by weight of N,N'-(2,6,2',6'-tetraisopropyldiphenyl)carbodiimide alone was used as capping agent for the carboxyl groups. The amount of 0.6% by weight corresponds to a value of 16.6 meq/kg; that is, an excess of 10.2 meq/kg of polymer was used. These conditions give a polyester monofilament which possesses very high stability to thermally hydrolytical attack. However, the disadvantage is the free monocarbodiimide content of 222 ppm in the finished product.

Example 3

Again Example 1 was repeated for comparative purposes. However, this time an amount of 0.876% by weight of the above-described polycarbodiimide was added, in the form of a 15% masterbatch. This experiment was carried out in order to examine once more the statements in the prior art according to which even a marked excess of polycarbodiimide gives rise to a reduced thermal and hydrolytic stability compared with the state of the art, presumably on account of the low reactivity. This example shows clearly that this is indeed the case. And it is interesting that even this selected amount of polycarbodiimide appears to lead to a marked degree of crosslinking of the polyester, as can be inferred from the distinct increase in the intrinsic viscosity values. In general, such crosslinking is acceptable in the case of filament-forming polymers only within narrow limits: it is strictly reproducible and does not give rise to spinning problems or problems in drawing the filaments produced therefrom.

Example 4

The process of Example 1 or Example 2 was repeated, except that this time monocarbodiimide was added in amounts calculated from the stoichiometric value or amounting to a 20% excess of monocarbodiimide. Again, the results obtained are listed below. In run 4*a*, the amount of monocarbodiimide added was precisely that required stoichiometrically, while run 4*b* was carried out with an excess of 1.3 meq of monocarbodiimide/kg. As shown in the Table, the relative residual strengths found following an 80 hour treatment at 135° C. in a water vapor atmosphere do not correspond to the state of the art. An excess of about 20%, as is also already discernible for example from the numerical data in DE Auslegeschrift 2,458,701, likewise does not as yet lead to the high hydrolytic stabilities as can be achieved according to the state of the art, for example according to Example 2. However, this means that, according to the state of the art, only an appreciable excess of monocarbodiimide gives a particularly good relative residual strength following a thermal-hydrolytic test. This is inevitably associated with a high level of free monocarbodiimide.

Example 5

Example 1 was repeated, except that this time not only monocarbodiimide but also a polycarbodiimide was used in accordance with the present invention.

In this experiment, 0.4% by weight of monocarbodiimide and 0.32% by weight of polycarbodiimide, based on polyester, were added.

As can be seen from the Table, the free monocarbodiimide content of the polyester thus prepared remains within the above-specified limits. The thermal-hydrolytic stability of this material is even slightly above that of the best prior art compositions.

The monofilament thus prepared was highly suitable for preparing papermaker's machine wire-cloths.

The experimental results and the reaction conditions are summarized in the Table below. Column 2 indicates the amount of monocarbodiimide added and column 3 the amount of polycarbodiimide in % by weight, based on the polyester.

Further columns show the measurements obtained from the resulting monofilaments, which each have a diameter of 0.40 mm. The carboxyl end group content in meq/kg is followed by the amount of free monocarbodiimide in ppm (by weight). The free carbodiimide content was determined by extraction and gas chromatographic analysis, similarly to the method described in JP Auslegeschrift 1-15604-89. Additional columns indicate the relative residual strength and the intrinsic viscosity of the individual filament samples.

| Example | Monocarbodiimide % by weight | Polycarbodiimide % by weight | COOH | Free monocarbodiimide ppm | Relative residual strength % | Intrinsic viscosity dl/g |
|---|---|---|---|---|---|---|
| 1 | — | — | 6.4 | 0 | 0 | 0.747 |
| 2 | 0.600 | — | 1.3 | 222 | 64 | 0.755 |
| 3 | — | 0.876 | 2.6 | <1 | 54 | 0.784 |
| 4a | 0.235 | — | 2.8 | 2 | 34 | 0.743 |
| 4b | 0.278 | — | 1.9 | 23 | 53 | 0.756 |
| 5 | 0.400 | 0.320 | <1.0 | 131 | 65 | 0.766 |

What is claimed is:

1. Polyester fibers or filaments which, following reaction with carbodiimides, have capped carboxyl end groups, the carboxyl end groups being predominantly capped by reaction with not more than 0.5 percent by weight of mono- and/or bis-carbodiimides which are present in the fibers and filaments in free form in an amount of 200 ppm or less, based on the weight of the polyester, the free carboxyl end group content being less than 3 meq/kg of polyester and the fibers or filaments additionally containing at least 0.02 percent by weight of at least one free polycarbodiimide or of a reaction product containing still reactive carbodiimide groups.

2. The fibers or filaments of claim 1, wherein the free mono- and/or biscarbodiimide content is from 30 to 150 ppm, based on the weight of the polyester.

3. The fibers or filaments of claim 1, containing at least one free polycarbodiimide or a reaction product containing still reactive carbodiimide groups in an amount of from 0.05 to 0.6, percent by weight.

4. The fibers or filaments of claim 1, wherein the polyester from which said fibers or filaments are formed has an average molecular weight corresponding to an intrinsic viscosity of at least 0.64 (dl/g) measured in dichloroacetic acid at 25° C.

5. Filaments as claimed in claim 1, comprising monofilaments having a round or profiled cross-section with a diameter or equivalent diameter of from 0.1 to 2.0 mm.

6. A process for preparing carbodiimide-stabilized polyester fibers or filaments which comprises adding to the polyester prior to spinning an amount of not more than 0.5% by weight of a mono- and/or biscarbodiimide and also at least 0.05% by weight, based on polyester, of at least one polycarbodiimide and then spinning the resulting composition into filaments where the capping of the carboxyl end group is predominantly effected by reaction with mono- and/or biscarbodiimides and said fibers or filaments contain in free form 200 ppm or less of said mono- and/or biscarbodiimide and 0.02 to 0.6 percent by weight of at least one free polycarbodiimide or of a reaction product containing still reactive carbodiimide groups, based on the weight of the polyester.

7. The process of claim 6, wherein the polyester to be spun has a carboxyl end group content of 20 meq/kg or less after spinning without carbodiimide addition.

8. The process of claim 6, wherein the polyester to be spun is molten, and the contact time between molten polyester and carbodiimide additions is less than 5 minutes.

9. The process of claim 6, wherein the polyester to be processed has an intrinsic viscosity of at least 0.64 (dl/g) measured in dichloroacetic acid at 25° C.

10. The process of claim 6, wherein the polycarbodiimide is added to the polyester to be processed as a concentrate or masterbatch in a polymer.

11. The process of claim 6, wherein the carbodiimides are added immediately prior to spinning of the polyester at a point upstream of or in the extruder.

12. The process of claim 6, wherein the monocarbodiimide used is N,N'-2,6,2',6'-tetraisopropyldiphenylcarbodiimide.

13. The process as claimed in claim 6, wherein the polycarbodiimide used is an aromatic polycarbodiimide which is isopropyl-substituted on the benzene nucleus in the o-position relative to the carbodiimide groups.

14. A wire-cloth for a papermaking machine, said wire-cloth comprising filaments of claim 1.

15. Polyester fibers or filaments of claim 1, wherein the free mono- and/or biscarbodiimide content is from 30 to 100 ppm, based on the weight of the polyester; the free carboxyl end group content is less than 1.5 meq/kg of polyester; and said polycarbodiimide or polycarbodiimides has or have an average molecular weight between about 5000 and 10,000.

16. Polyester fibers or filaments of claim 3, wherein said amount is from 0.1 to 0.5 percent by weight.

17. The process of claim 8, wherein said contact time is less than 3 minutes.

18. The process of claim 10, wherein the masterbatch containing the polycarbodiimide consists essentially of polyester.

19. The process as claimed in claim 6, wherein more monocarbodiimide is present than polycarbodiimide.

20. The polyester fibers or filaments as claimed in claim 1, wherein said fibers or filaments contain in free form an amount from 30 to 100 ppm of said mono- and/or biscarbodiimides based on the weight of the polyester and the free carboxyl end group content is less than 1.5 meq/kg of polyester.

* * * * *